US010575593B2

(12) United States Patent
Islas Mares

(10) Patent No.: US 10,575,593 B2
(45) Date of Patent: Mar. 3, 2020

(54) SHOE CONVERTIBLE FROM A CONVENTIONAL SHOE INTO A SAFETY SHOE WITH A CASING

(71) Applicant: Octavio Augusto Islas Mares, Colonia Rancho la Mora (MX)

(72) Inventor: Octavio Augusto Islas Mares, Colonia Rancho la Mora (MX)

( * ) Notice: Subject to any disclaimer, the term of this patent is extended or adjusted under 35 U.S.C. 154(b) by 66 days.

(21) Appl. No.: 15/904,625

(22) Filed: Feb. 26, 2018

(65) Prior Publication Data

US 2018/0177262 A1 Jun. 28, 2018

Related U.S. Application Data

(63) Continuation of application No. PCT/MX2016/050012, filed on Aug. 24, 2016.

(51) Int. Cl.

| | |
|---|---|
| ***A43B 23/08*** | (2006.01) |
| ***A43C 13/14*** | (2006.01) |
| ***A43B 7/32*** | (2006.01) |
| ***A43B 3/20*** | (2006.01) |
| ***A43B 3/24*** | (2006.01) |

(52) U.S. Cl.

CPC ..... *A43C 13/14* (2013.01); *A43B 3/20* (2013.01); *A43B 3/24* (2013.01); *A43B 3/242* (2013.01); *A43B 7/32* (2013.01); *A43B 23/081* (2013.01)

(58) Field of Classification Search

CPC ..... A43B 3/24; A43B 3/242; A43B 23/08; A43B 23/081

USPC ..... 36/100, 101, 72 R, 77 R, 132, 136

See application file for complete search history.

(56) References Cited

U.S. PATENT DOCUMENTS

| | | | | | |
|---|---|---|---|---|---|
| 2,068,946 | A | * | 1/1937 | Ferguson | A43B 23/20 36/1 |
| 2,268,435 | A | * | 12/1941 | Zucker | A43C 13/14 36/7.5 |
| 2,334,474 | A | * | 11/1943 | Chertok | A43C 13/14 36/72 R |
| 2,373,596 | A | * | 4/1945 | Popik | A43C 13/14 338/32 R |
| 2,615,261 | A | * | 10/1952 | La Grotto | A43C 13/14 33/18.3 |
| 2,625,753 | A | * | 1/1953 | Null | A43C 13/14 36/72 R |

(Continued)

FOREIGN PATENT DOCUMENTS

FR 2798829 3/2001

*Primary Examiner* — Marie D Bays

(74) *Attorney, Agent, or Firm* — Miller Law Group, PLLC

(57) ABSTRACT

A system for protecting the toes comprises a pair of shoes with certain adaptations so that a removable portable element with a casing can be fitted thereto and removed therefrom easily and quickly, by means of three lower tabs—two side tabs and one front tab—which fit to the sole of the shoe, and two straps—an inner strap and an outer strap—which fasten to the shoe. The characteristics the shoe and removable element mean that when the removable element is fitted, it does not extend beyond the limits of the footprint, and therefore comfort and aesthetics are not compromised when the shoes are worn. The system also has the flexibility of being able to have a wide range of standardized designs per model and size, which can then be interchanged with each other in order to increase the design options for the user.

2 Claims, 4 Drawing Sheets

(56) References Cited

U.S. PATENT DOCUMENTS 2,927,384 A * 3/1960 Duffy ..... A43C 13/14 36/72 R
3,037,304 A * 6/1962 Duffy ..... A43B 23/082 36/72 R
3,040,455 A * 6/1962 Criswell ..... A43C 13/14 36/72 R
3,126,651 A 3/1964 Brown
3,206,874 A * 9/1965 Ellis ..... A43B 7/32 36/72 R
3,841,004 A * 10/1974 Gray ..... A43C 13/10 36/72 R
3,906,646 A 9/1975 Milotic
4,005,534 A * 2/1977 Crist ..... A43C 13/14 36/72 R
4,333,248 A * 6/1982 Samuels ..... A43B 3/18 36/101
4,995,174 A * 2/1991 Hong ..... A43C 13/14 36/72 R
5,074,060 A * 12/1991 Brncick ..... A43C 13/14 36/72 R
5,410,821 A * 5/1995 Hilgendorf ..... A43B 1/0081 36/100
5,711,092 A * 1/1998 Despres ..... A43C 13/14 36/133
6,131,312 A * 10/2000 Hung ..... A43B 7/32 36/11.5
7,127,836 B1 * 10/2006 Jamison ..... A43B 3/16 36/72 R
7,451,553 B2 * 11/2008 Dun ..... A43B 1/009 36/100
2004/0049949 A1 * 3/2004 Valentini ..... A43B 1/0072 36/77 R
2008/0052959 A1 * 3/2008 Hu ..... A43B 1/0081 36/42
2014/0053432 A1 2/2014 Delaney

* cited by examiner (A-A')

(B-B')

(C-C')

(DET "M")

SHOE CONVERTIBLE FROM A CONVENTIONAL SHOE INTO A SAFETY SHOE WITH A CASING

CROSS REFERENCE TO RELATED APPLICATIONS

This application is a continuation of International PCT Application No. PCT/MX2016/050012, filed Aug. 24, 2016.

BACKGROUND

Currently there are people whose activity makes it necessary for them to protect their toes to prevent or lessen any injury should a heavy object accidently fall on them. The objective of the present invention is to offer a new portable solution. By adding a removable element, a pair of common shoes can be transformed, with the adaptations that will be seen hereinafter, into safety shoes and vice versa, offering various benefits that will be detailed below. Such benefits cannot be found collectively in any of the devices existing for that purpose today.

The characteristics of current removable element systems are most appropriate for occasional use, such as for visitors to a hazardous area who require immediate protection but are wearing street shoes and do not have common safety shoes. In this case neither comfort nor aesthetics are considered important, but rather simply having a quick solution. The system of the present invention for protecting the toes is focused on offering a solution that is portable but not for occasional use. In addition to performing its primary function of protection, it is focused also on the characteristics of comfort and aesthetics. What is more, it has the flexibility of being able to interchange the components of said shoe/removable element system. This increases the possibilities of wearing safety shoes of different designs.

Currently there are safety shoes that have a part commonly called casing that can be steel, plastic or some other material and of different configurations. It is incorporated in the shoe above the toes and protects them should a heavy object accidentally fall on them, reducing or avoiding the effect that such impact could have.

It has also been observed that for most people the use of safety shoes is uncomfortable because they are both more rigid and heavier than any common street shoe. As a result, they avoid using them as much as possible. Many people even opt to carry their safety shoes without wearing them, putting them on only when arriving at the area where they are required. In the same way they change back to common shoes without casing upon leaving said area.

In addition to the above-mentioned safety shoes with casing, two alternate types of devices are known that are used for the same purpose and can be placed on various types of shoe. One of them is called toe cap, which is basically a casing that has some elements that can be placed on the front part of the shoe, and the other is a rubber sleeve that totally or partially covers the shoes already being worn by the user. Said rubber sheet has the casing incorporated therein (Spanish Patent No. ES2230932 "Protective toe cap" and European patent EP2425731 "Safety overshoe"). In the first case, since it can be used for any type of shoe that the user may be wearing, and since those shoes can be of numerous shapes and sizes, the toe cap has a very ample size and shape so that most shoes can fit within it. As a result, it protrudes from the shoe because it is larger than the normal shoe. In addition, in order to be able to provide safety it contains elements that go between the sole, the ground and the back part of the shoe, making it uncomfortable and bulky for walking. It also can damage the shoe while fulfilling its protective function, but without including comfort or aesthetics. In the case of the sleeve option for the shoe with incorporated casing, the sleeve comes in sizes that must correspond to the size of the shoe on which it is to be used. However, since it must slip onto the shoe it must be practically larger than the normal shoe, making walking difficult and uncomfortable. Moreover, it also does not cover the aesthetic function and can damage the shoe. Since the current devices with removable element do not have the characteristics of comfort or aesthetics, they are considered more appropriate for temporary use, and in the event a visitor to a hazardous area requiring protection for the toes does not have common safety shoes at that time, in such cases comfort or aesthetics is not considered important, but rather simply a quick solution for protecting the toes.

SUMMARY OF THE INVENTION

Considering the above, a shoe system has been devised that is convertible, i.e. it is a conventional shoe and when required an additional portable part can be installed relatively quickly and easily, converting it into a safety shoe. In the same way, it can be removed when no longer needed. Said removable element is characterized in that it contains a casing and is provided with the appropriate shape and design to fit properly, so that once installed and in position it is contained in the shoe, i.e. it does not exceed the size and shape of the shoe's footprint, making it feel like a common safety shoe. Upon removing this part, it feels and looks like any conventional shoe. Thus, in addition to the protective function for the foot, it offers comfort and aesthetics that current systems do not have. It should be mentioned that the present invention also has the flexibility to be able to have a large number of designs for all tastes by changing materials, shapes, components, colors and textures, both of the removable element thereof as well as of the shoe, and by being standardized by model and size, they can be interchanged as desired.

One aspect of the present invention is a system that has two components, a shoe with the necessary adaptations for containing the other part thereof, called removable element, i.e. which can be installed and removed depending on how it is to be used, and which has the previously mentioned benefits that current devices for the same purpose do not have.

The parts and characteristic details of these convertible shoes are shown clearly in the following description and in the accompanying drawings.

DETAILED DESCRIPTION

Figure 1:
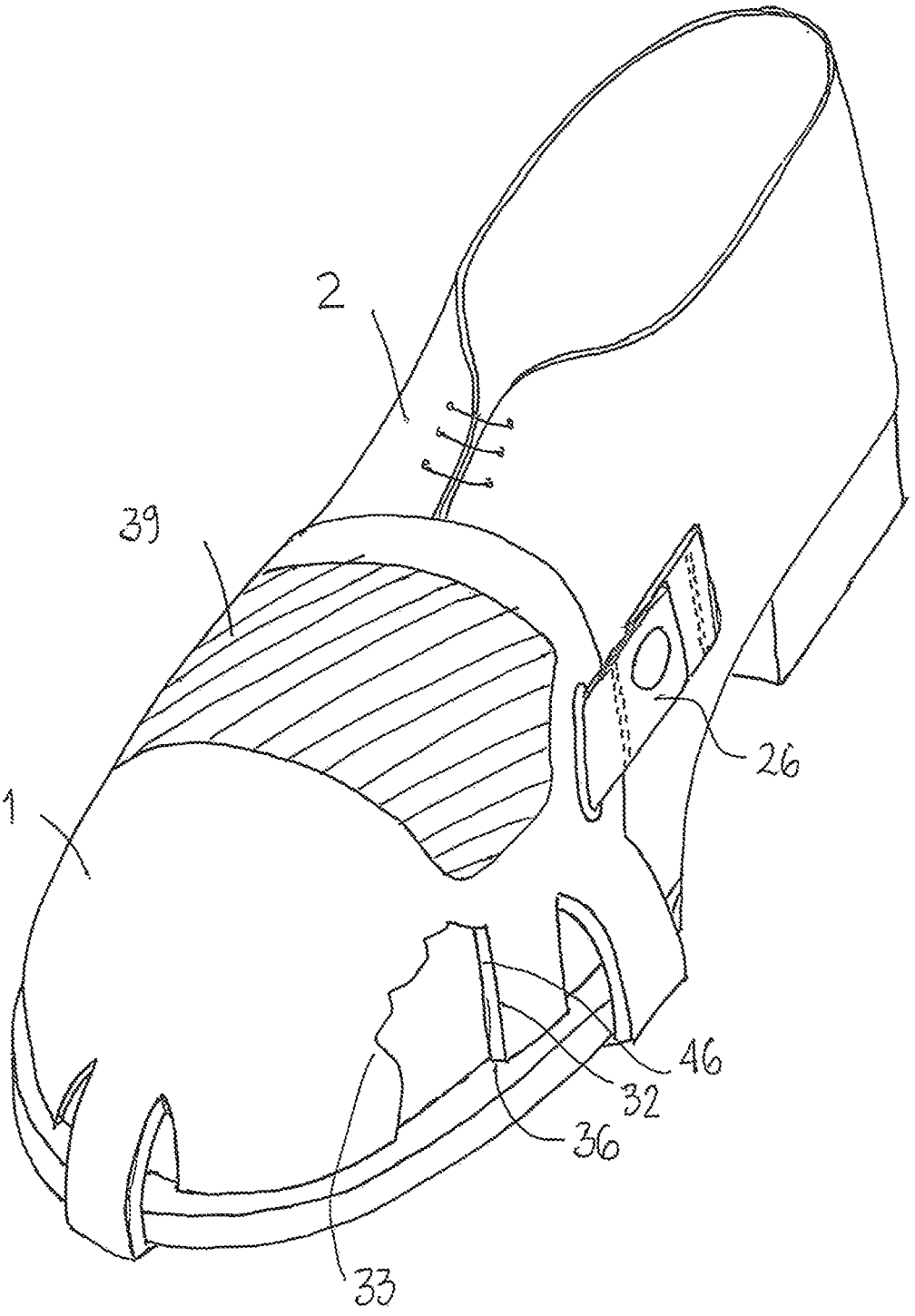
FIG. 1 is a perspective view of the shoe with the removable part thereof installed and in position.

The convertible shoes of the present invention are convertible from conventional shoes into safety shoes with a casing. To enable such function, a convertible shoe system comprises two components (1, 2), the first of which is a part called a removable element (1), which in turn incorporates an element called a safety casing (3) and another element called a strap of the removable element (26), while the second is the shoe (2) itself, which has the characteristics that will be described hereinafter in order to appropriately accommodate and contain the first mentioned component. Said removable element (1) can be internally and externally lined, totally or partially, with a covering material, such as cloth, leather, synthetic material or any other, including any combination thereof and having any design, as well as textures, color, stamping or any combination thereof. This feature is called exterior-part covering (32) for the visible part of the shoe once the removable element (1) is installed, and interior-part covering (46) for the part that is not visible once the removable element (1) is installed, the face whereof is installed towards the shoe (2). The primary function of said interior-part covering (46) is to protect the shoe from contact with the removable element (1) during the installation and removal thereof. In the same way, said removable element (1) can simply omit the exterior-part covering (32) or the interior-part covering (46).

Figure 4:
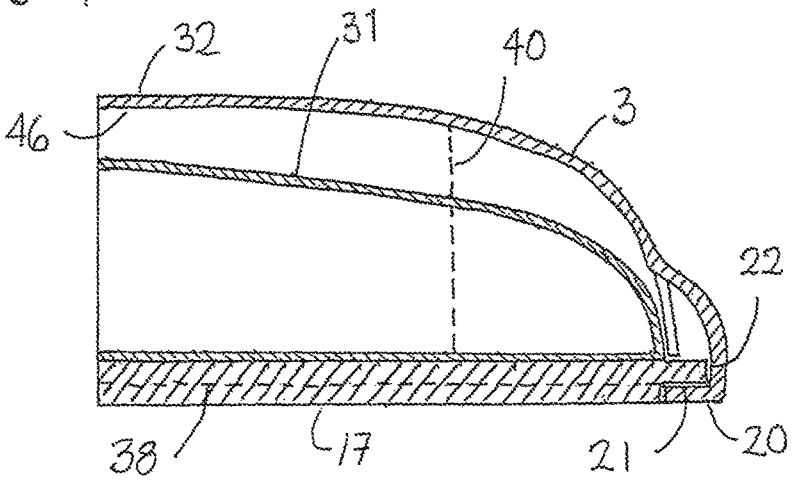
FIG. 4 is the cross-section A-A' indicated in FIG. 3, which is a longitudinal cross-section passing through the middle of the shoe with the removable part thereof installed and in position.
Figure 7:
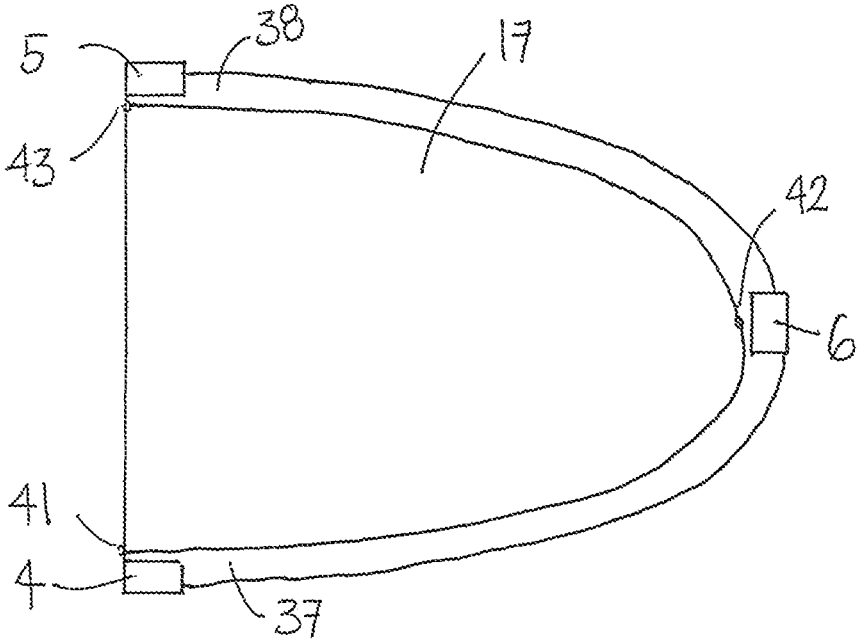
FIG. 7 is part of the sole of the shoe with the removable part thereof installed and in position, viewed from below, i.e. the part that touches the floor when walking, showing only the area corresponding to said removable part.

The removable element (1) is provided with three lower tabs (4, 5, 6), one on each side of the shoe, i.e. at the medial and outer lateral sides thereof, which are called medial lower side tab (4) and lateral lower side tab (5), and the third on the front part, called lower front tab (6). The medial lower side tab (4) and the lateral lower side tab (5) are bent towards the inner part of the shoe as shown in details (15, 16) respectively, which have been called medial lower side bend (15) and lateral lower side bend (16). Said bends are accommodated in a medial lower side recess (37) and lateral lower side recess (38), which are in the bottom of the sole of the shoe (35) and run along the outline of the sole, as represented in FIG. 7 by the line that connects points (41, 42 and 43). Said bends also have contact with the lateral side edge of the sole (18) and medial side edge of the sole (19). Similarly, the lower front tab (6) has a lower front bend (20) that is accommodated in a lower front recess (21) of the sole, provided for that purpose. Said lower front bend is also in contact with the front edge of the sole (22) as shown in FIG. 4.

Figure 2:
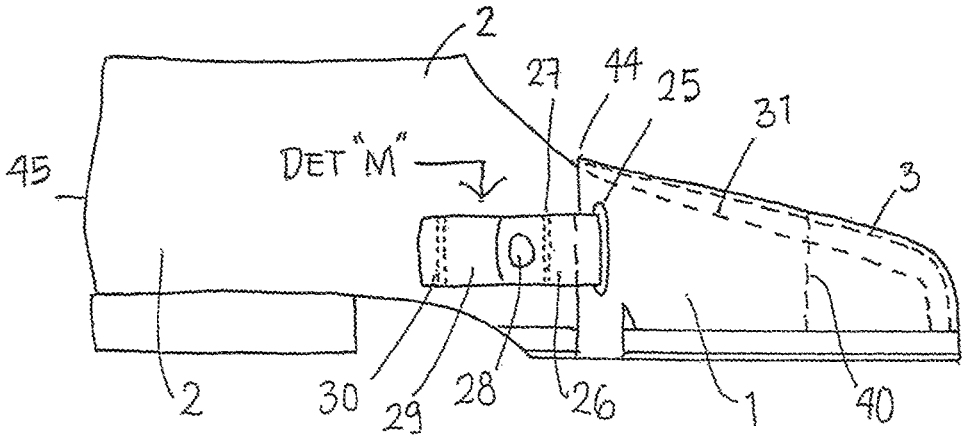
FIG. 2 is a side view showing the shoe from one side thereof (which can represent the medial or lateral side of the shoe) with the removable part thereof installed and in position.
Figure 3:
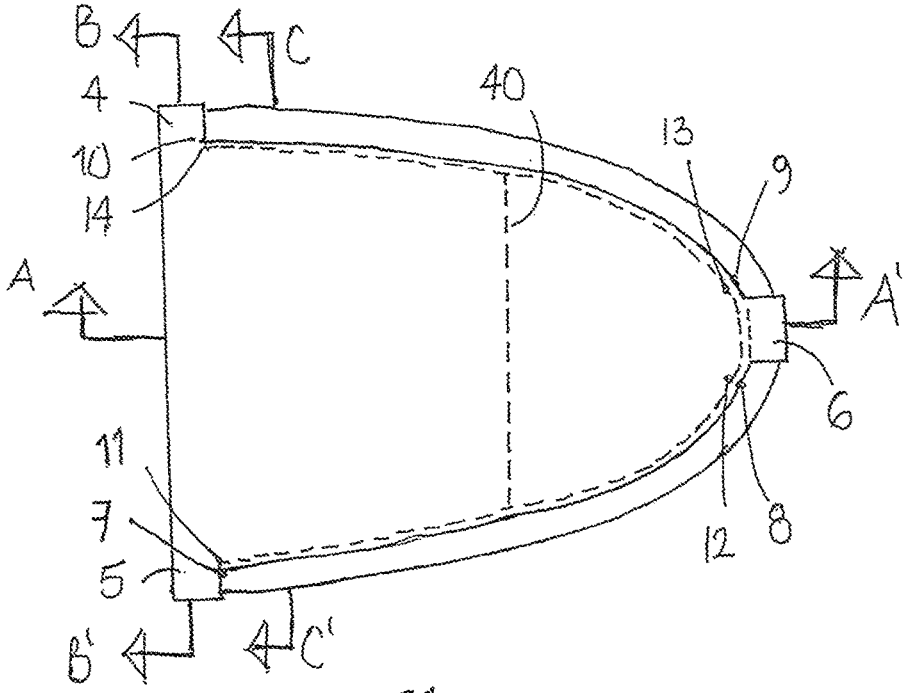
FIG. 3 is a top view of the shoe with the removable part thereof installed and in position, showing only the area corresponding to said part; in this view the different cross-sections are also identified, which are used to illustrate other figures mentioned hereinafter.
Figure 6:
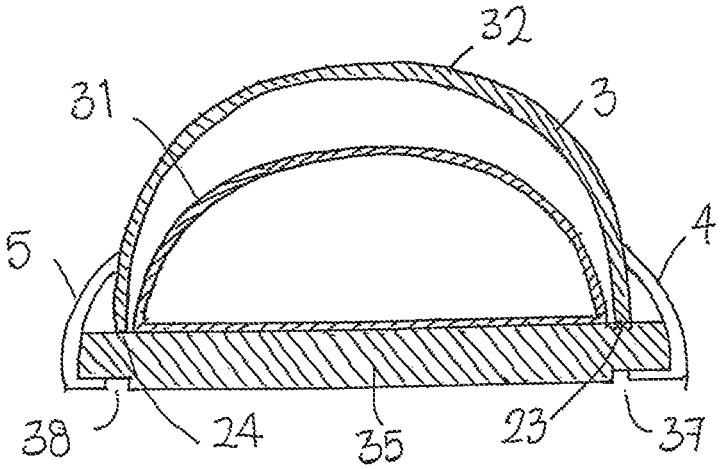
FIG. 6 is the cross-section C-C' indicated in FIG. 3, which is a transverse cross-section of the shoe with the removable part thereof installed and in position.
Figure 8:
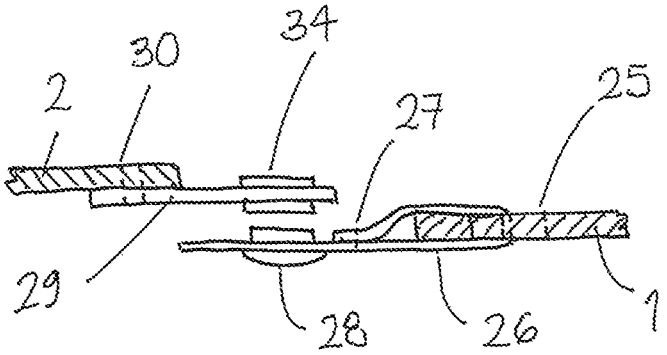
FIG. 8 is the detail M indicated in FIG. 2.

Said removable element (1) also has an outer lower edge, which is represented by an external line that passes through points (7, 8, 9 and 10). An internal broken line passes through points (11, 12, 13 and 14) and is called an inner lower edge of the removable element. The surface bound by these edges will have contact with the top surface of the sole at the upper peripheral area thereof that protrudes beyond a remainder of the shoe that covers at least one section of the sole. This contact can be seen at points (23 and 24), which represent only one pair of points in the cross-sections C-C' of FIG. 6. Said contact can also be seen in FIG. 1 (36), in which an imaginary cross-section of the casing (33) of the removable element (1) has been represented, for better visualization. The previously described attachments ensure that the removable element (1) cannot be moved upwards, downwards or backwards. In addition, the removable element (1) contains a slot (25) through which a strap (26) of the removable element passes in a U-shaped loop, as shown in FIGS. 2 and 8, and is stitched to itself. Said strap (26) is also provided with a male snap part (28), which is fastened to the counterpart thereof, namely a female snap part (34), which is secured to another strap called shoe strap (29), which in turn is sewn to the shoe (2) by stitching (30). The function of this attachment, described by the removable element strap assembly (26) and the shoe strap assembly (29), is to prevent the forward movement of the removable element (1) of the shoe (2). This attachment ensures that the removable element (1) cannot be moved from its position when using the present system as a safety shoe, as can be seen in FIGS. 1 and 2. In addition to the previously described attachment system, other methods can be used as described below, including but not limited to: instead of the male and female snap parts (28 and 34), a hook and loop fastener can be used, or a buckle system or zipper system. It can also be replaced by a single strap that contains an elastic element and is simply sewn to the inner part of the removable element (1) and outer part of the shoe (2). To position the removable element, the elastic can be used to pull backwards so that it is positioned at the rear part of the shoe (45) with a certain amount of tension on the elastic to ensure that the removable element (1) does not move towards the front of the shoe (2).

Figure 5:
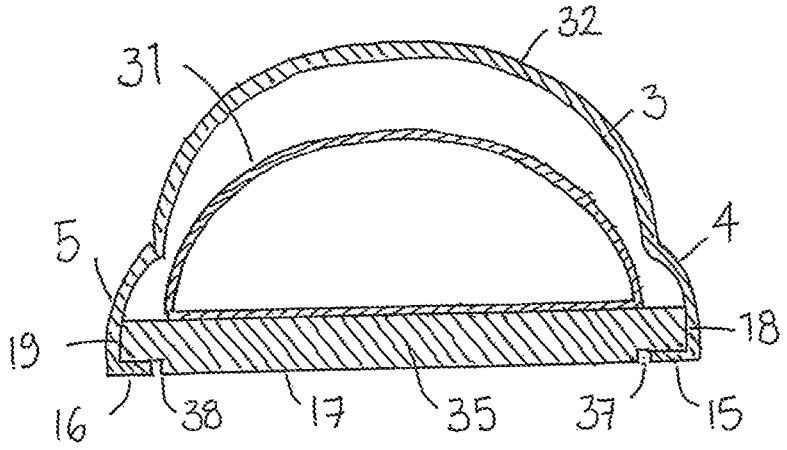
FIG. 5 is the cross-section B-B' indicated in FIG. 3, which is a transverse cross-section of the shoe with the removable part thereof installed and in position, which passes through side tabs of the removable element.

Moreover, in FIG. 2 it can be seen that the removable element (1), in the installed position thereof, is above the upper (31) of the shoe, illustrated by a broken line. It can also be seen in FIGS. 4, 5 and 6 that said removable element (1) contains the safety casing (3), which will protect the toes. It should be mentioned that the safety casing (3), as part of the removable element (1), is shown in the drawings as occupying the entire removable element (1). However, the configuration can be changed such that the protection part provides only partial coverage, for example only a minimum protection area for the toes, up to full coverage spanning the entirety of the removable element (1). For example, a partial coverage example is illustrated in a broken line called casing boundary line (40). Moreover, the removable part (1) could have an opening or series of openings in the area shown in FIG. 1, referred to as an uncased area (39), for the purpose of reducing weight. Also, as one of the aesthetic design configurations thereof, said removable element (1) can have an endless number of shapes and designs other than those shown in the present specification, being adapted fully or partially to the shape of the shoe provided it fits and can be adapted to the shoe (2) as was previously described. Moreover, the removable element (1) can be made standardized by model and size of shoe, and can have a large number of designs of removable element (1) for each model of shoe (2) and vice versa.

Furthermore, it has been considered that the material both of the removable part (1) and of the safety casing (3) can be of any kind and can have any design, such as color, texture or combination thereof. The safety casing (3) can also have any developed configuration provided it complies with the characteristics of the current regulations on safety shoes for the respective entity.

Finally, it is stipulated that the removable element (1) may optionally lack the safety casing (3). In the absence of the safety casing, the function of protecting the toes would no longer be in effect, and the objective of the casing-free removable element would be to have a system that allows various shoe designs to be achieved.

The invention claimed is:

1. A convertible shoe apparatus comprising a shoe and a removable element, wherein said shoe comprises a sole and a front part of the removable element is installed, or configured for installment, on the sole; said sole comprises at least one recess at a bottom of said sole at a periphery thereof; said sole comprises an upper peripheral area that protrudes beyond a remainder of the shoe that covers at least one section of said sole; the removable element is characterized in that it has three tabs thereon at a lower part thereof, including a medial side tab at a medial side of said lower part, a lateral side tab at a lateral side of said lower part, and a front tab at a front of said lower part; the side tabs and the front tabs each have an inwardly-reaching bend engaged in, or configured for engagement in, said at least one recess of the sole; said removable element comprises a lower outer edge, at least one section of which contacts, or is configured to contact, the upper peripheral area of the sole, such that the removable element is contained within a footprint of the shoe; the side tabs, the front tab and the lower outer edge are configured to serve as attachment between the removable element and the sole, since once installed and in position on the sole, the removable element, through engagement of the side and front tabs with the at least one recess and contact of the lower outer edge with the upper peripheral area of the sole, prevents the movement of the removable element backwards, upwards and downwards relative to the sole; the removable element has two slots, one in a medial part of said removable element and another in a lateral part thereof; a respective strap passes through each slot in a U-shaped loop and is sewn onto itself, and is provided with one of two counterparts of a snap, the other of said two counterparts being installed on another respective strap sewn to the shoe, such that when the two counterparts are fastened together, the removable element is secured from being able to move forward relative to the shoe, thereby completing installation of the removable element to the shoe, and preventing movement of the removable element in any direction relative to the shoe.

2. The convertible shoe apparatus of claim 1, wherein the removable element comprises a protection part configured for protection of a wearer's toes, whereby when the removable element is installed on the shoe, the removable element and the shoe cooperatively function as a safety shoe, and when said removable element is uninstalled from the shoe, the shoe functions as a conventional shoe.

* * * * *